US007985166B2

(12) United States Patent
Farnsworth et al.

(10) Patent No.: US 7,985,166 B2
(45) Date of Patent: Jul. 26, 2011

(54) TREADMILL CONVERSION RESISTANCE TRAINING APPARATUS

(75) Inventors: Rick Farnsworth, Brush Prairie, WA (US); Douglas G. Dixon, Longview, WA (US)

(73) Assignee: AVERO Fitness, LLC, Brush Prairie, WA (US)

( * ) Notice: Subject to any disclaimer, the term of this patent is extended or adjusted under 35 U.S.C. 154(b) by 1 day.

(21) Appl. No.: 12/506,095

(22) Filed: Jul. 20, 2009

(65) Prior Publication Data

US 2010/0016127 A1 Jan. 21, 2010

Related U.S. Application Data

(60) Provisional application No. 61/135,622, filed on Jul. 21, 2008.

(51) Int. Cl.
*A63B 22/02* (2006.01)
*A63B 22/00* (2006.01)

(52) U.S. Cl. ..... 482/54; 482/51

(58) Field of Classification Search ..... 482/52, 482/54, 57–65, 139, 148, 51, 126, 121, 70, 482/904
See application file for complete search history.

(56) References Cited

U.S. PATENT DOCUMENTS

| | | | | |
|---|---|---|---|---|
| 1,019,861 | A | | 3/1912 | Titus |
| 1,390,095 | A | | 9/1921 | Dettinger et al. |
| 2,919,134 | A | | 12/1959 | Zuro |
| 4,304,402 | A | | 12/1981 | Ripp |
| 4,625,962 | A | | 12/1986 | Street |
| 4,979,731 | A | | 12/1990 | Hermelin |
| 5,013,035 | A | | 5/1991 | Nathaniel |
| 5,104,119 | A | * | 4/1992 | Lynch ..... 482/5 |
| 5,178,591 | A | | 1/1993 | Lyons |
| 5,254,064 | A | | 10/1993 | Rock |
| 5,269,737 | A | | 12/1993 | Sobotka |
| 5,277,684 | A | | 1/1994 | Harris |
| 5,324,243 | A | * | 6/1994 | Wilkinson ..... 482/92 |
| 5,405,305 | A | | 4/1995 | Wilkinson et al. |
| 5,584,783 | A | | 12/1996 | Hagg et al. |
| 5,595,556 | A | * | 1/1997 | Dalebout et al. ..... 482/54 |
| 5,632,708 | A | | 5/1997 | Wilkinson et al. |
| 5,662,560 | A | * | 9/1997 | Svendsen et al. ..... 482/69 |
| 5,720,702 | A | * | 2/1998 | Lee ..... 482/129 |

(Continued)

OTHER PUBLICATIONS

International Search Report for PCT/US09/51236, dated Sep. 3, 2009 (relating to related copending PCT application).

(Continued)

*Primary Examiner* — Steve R Crow
(74) *Attorney, Agent, or Firm* — Rylander & Associates P.C.; Mark E. Beatty; Kurt M. Rylander

(57) ABSTRACT

A treadmill conversion resistance training apparatus includes mirror-image left and right attachments for attaching to treadmill vertical support columns, each attachment having a vertical mounting bracket removably attachable to a vertical support column; a translation member rotatingly connectable to the vertical mounting bracket at a translation axis; resistance straps removably connectable between the translation member and the mounting bracket; a handle connectable to the translation member and lockable at selected angles; wherein, the treadmill to continues to function as an treadmill while the apparatus is attached. A treadmill conversion apparatus includes a handle having an articulation joint lockable at selectable angles. A treadmill conversion apparatus includes a handle joint having adjustable resistance portion.

15 Claims, 5 Drawing Sheets

U.S. PATENT DOCUMENTS

| | | | | |
|---|---|---|---|---|
| 5,803,874 | A | 9/1998 | Wilkinson | |
| 5,997,448 | A | 12/1999 | Dubna | |
| 6,117,056 | A * | 9/2000 | Cataldi et al. | 482/121 |
| 6,450,923 | B1 * | 9/2002 | Vatti | 482/8 |
| 6,520,891 | B1 | 2/2003 | Stevens, Jr. | |
| 7,585,254 | B1 * | 9/2009 | Vittone et al. | 482/54 |
| 7,775,943 | B2 * | 8/2010 | Vittone et al. | 482/70 |
| 2004/0204294 | A2 | 10/2004 | Wilkinson et al. | |
| 2007/0191197 | A1 | 8/2007 | Vittone et al. | |

OTHER PUBLICATIONS

International Preliminary Report on Patentability for PCT/US09/51236, dated Jun. 24, 2010 (relating to related copending PCT application).

International Search Report for PCT/US09/62424, dated Jan. 7, 2010 (relating to a copending PCT application directed to related technology).

* cited by examiner

TREADMILL CONVERSION RESISTANCE TRAINING APPARATUS

CROSS-REFERENCE TO RELATED APPLICATIONS

This application claims priority to U.S. Provisional Application Ser. No. 61/135,622 filed Jul. 21, 2008, which is hereby incorporated by reference into this application.

FIELD OF THE INVENTION

The present invention relates to resistance training exercise apparatus. More particularly, the present invention relates to apparatus and methods for converting an exercise treadmill for resistance training strength workouts.

BACKGROUND

Home exercise machines are widespread. Some machines provide aerobic exercise, such as treadmills and other "cardio machines." Some machines provide strength training such as weight machines and resistance machines using elastic straps or resistance gears. Examples include such suppliers as BOWFLEX™ and NAUTILUS™. These machines have drawbacks, however. These machines are essentially single purpose—they provide either a cardio workout or a strength workout, but can't provide for both in the same footprint. Most people have limited space in their home or office to store and use exercise equipment and don't have room for both a cardio machine and a strength machine. These machines can also be quite expensive. The cost of purchasing a stand-alone cardio machine and a stand-alone strength machine can be prohibitive for many.

The ability to squeeze more productivity out of the same old treadmill machine is motivating to fitness buffs, and this positive spirit can translate into better workouts and improved health. The world benefits. Spending extra money for a second exercise machine, and trying to cram a second machine into a space that was not big enough for the original treadmill to begin with, makes people sad. They become frustrated and cease working out altogether, reverting to a life of eating chips and watching TV. The world is harmed.

Many people who already own treadmills would benefit from additional strength exercises, but the space taken by treadmills (which include motors, displays, support rails, and oversized footprints for safety reasons) precludes purchasing another exercise machine. Moreover, an effective strength training machine should provide for multiple positions and multiple angles of resistance in order to work different muscle groups. An effective strength training machine should provide for exercises in the supine and standing positions. Importantly, persons who have already purchased an expensive, space-consuming treadmill would benefit greatly from being able to add strength training devices to their existing machine rather than have to obtain a new combination machine.

Thus, there is a need for a method and apparatus to convert an existing exercise treadmill into a strength training machine without negating its ability to operate as a treadmill. Such a machine should also be able to accommodate A number of devices have provided treadmills and resistance exercises, but lack the ability to convert an operating treadmill for resistance training, with the ability to perform exercises in a sitting or supine position as well as while walking on the treadmill. Presently known art attempts to address this problem, but has not completely solved the problem. The following represents a list of known related art:

| Reference: | Issued to: | Date of Issue: |
|---|---|---|
| U.S. 2007/0191197 A1 | Vittone et al. | pub. Aug. 16, 2007 |
| U.S. Pat. No. 6,520,891 B1 | Stevens, Jr. | Feb. 18, 2003 |
| U.S. Pat. No. 5,997,448 | Dubna | Dec. 7, 1999 |
| U.S. Pat. No. 5,632,708 | Wilkinson et al. | May 27, 1997 |
| U.S. Pat. No. 5,584,783 | Hagg et al. | Dec. 17, 1996 |
| U.S. Pat. No. 5,405,305 | Wilkinson et al. | Apr. 11, 1995 |
| U.S. Pat. No. 5,269,737 | Sobotka | Dec. 14, 1993 |
| U.S. Pat. No. 5,254,064 | Rock | Oct. 19, 1993 |
| U.S. Pat. No. 5,178,591 | Lyons | Jan. 21, 1993 |
| U.S. Pat. No. 5,013,035 | Nathaniel | May 7, 1991 |
| U.S. Pat. No. 4,304,402 | Ripp | Dec. 8, 1981 |
| U.S. Pat. No. 2,919,134 | Zuro | Dec. 29, 1959 |
| U.S. Pat. No. 1,390,095 | Dettinger et al. | Sep. 6, 1921 |
| U.S. Pat. No. 1,019,861 | Titus | Mar. 12, 1912 |

The teachings of each of the above-listed citations (which does not itself incorporate essential material by reference) are herein incorporated by reference. None of the above inventions and patents, taken either singularly or in combination, is seen to describe the instant invention as claimed.

U.S. Patent Publication 2007/0191197A1, by Vittone et al., teaches an exercise machine including an elastic band and a tension fulcrum positioned so that the band extends around the tension fulcrum to provide resistance exercise to the user. The system is designed as an integral machine, with individually moving vertically oriented handles, operating in a motion akin to cross country skiing. Vittone does not teach apparatus or methods for converting an existing treadmill to provide strength training. Vittone does not teach apparatus or methods permitting strength exercises from a supine position.

U.S. Pat. No. 6,520,891 B1, to Stephens, teaches a treadmill integrated with a lever handle attached to a height adjustable stanchion with spring tensioners providing resistance. Stephens does not teach apparatus or methods for converting an existing treadmill to provide strength training. Stephens does not teach apparatus or methods permitting strength exercises from a supine position.

U.S. Pat. No. 5,997,448, to Dubna, teaches a strength exercise apparatus using elastic bands for resistance. The bands are attached to a fixed post with height-adjustable cross piece. Dubna does not teach apparatus or methods for converting an existing treadmill to provide strength training. Dubna does not teach apparatus or methods permitting strength exercises using a treadmill from a supine position.

U.S. Pat. No. 5,632,708 and U.S. Pat. No. 5,405,305, to Wilkinson et al, consists of an elastic band attached to a bicycle or treadmill. The user pulls directly on the elastic band for resistance exercise. Wilkinson does not teach the use of a translation wheel. Wilkinson does not teach Wilkinson does not teach apparatus or methods permitting strength exercises using a treadmill from a supine position.

U.S. Pat. No. 5,584,783, to Hagg et al, teaches a system for modifying a stationary bicycle for strength exercises by attaching longitudinal rails to the base of the stationary bicycle and attaching elastic bands to the rails using sliding clamps. Hagg does not teach apparatus or methods for converting an existing treadmill to provide strength training. Hagg does not teach the use of a translation wheel. Hagg does not teach apparatus or methods permitting strength exercises using a treadmill from a supine position.

U.S. Pat. No. 5,269,737, to Sobotka, teaches an exercise device for exercising the oblique and upper torso muscles using elastic bands. Sobotka does not teach apparatus or methods for converting an existing treadmill to provide strength training. Sobotka does not teach the use of a translation wheel. Sobotka does not teach apparatus or methods permitting strength exercises using a treadmill from a supine position.

U.S. Pat. No. 5,254,064, to Rock, teaches the use bare elastic cords attached to a center post of an exercise treadmill for strength training. Operation requires the user pull directly on the cords using hand rings. Rock does not teach the use of a translation wheel. Rock does not teach apparatus or methods permitting strength exercises using a treadmill from a supine position.

U.S. Pat. No. 5,178,591 to Lyons teaches a T-bar attachment for a central post of a stair-stepper machine. The central T-bar includes hooks for elastic straps which straps a user can use for exercises. Operation requires the user pull directly on the cords using hand rings. Lyons does not teach the use of a translation wheel. Lyons does not teach apparatus or methods permitting strength exercises using a treadmill from a supine position.

U.S. Pat. No. 5,013,035, to Nathaniel, teaches a vertical arched frame with attachment points for elastic bands which can be used for resistance exercises. Operation requires the user pull directly on the cords using hand rings. Nathaniel does not teach the use of a translation wheel. Nathaniel does not teach adapting a treadmill for resistance exercise training. Nathaniel does not teach apparatus or methods permitting strength exercises using a treadmill from a supine position.

U.S. Pat. No. 4,304,402, to Ripp, teaches an exercise apparatus using elastic bands where a user anchors one end with their feet and pulls the opposite end of the straps, which are connected to a handle. Operation requires the user pull directly on the cords using a hand grip. Ripp does not teach the use of a translation wheel. Ripp does not teach adapting a treadmill for resistance exercise training. Ripp does not teach apparatus or methods permitting strength exercises using a treadmill from a supine position.

U.S. Pat. No. 2,919,134, to Zuro, teaches an expandable rod, for inserting horizontally between vertical walls, which rod includes connections for springs usable for resistance training. Operation requires the user pull directly on the springs using hand rings. Zuro does not teach the use of a translation wheel. Zuro does not teach adapting a treadmill for resistance exercise training. Zuro does not teach apparatus or methods permitting strength exercises using a treadmill from a supine position.

U.S. Pat. No. 1,390,095, to Dettinger et al, is similar to Zuro, teaching an adjustable frame which can be anchored to a wall and adjoining floor, anchoring springs usable for resistance training. Operation requires the user pull directly on the springs using hand rings. Dettinger does not teach the use of a translation wheel. Dettinger does not teach adapting a treadmill for resistance exercise training. Dettinger does not teach apparatus or methods permitting strength exercises using a treadmill from a supine position.

U.S. Pat. No. 1,019,861, to Titus, teaches a device essentially similar to Ripp: an exercise apparatus using elastic bands where a user anchors one end with their feet and pulls the opposite end of the straps, which are connected to a handle. Operation requires the user pull directly on the cords using a hand grip. Titus does not teach the use of a translation wheel. Titus does not teach adapting a treadmill for resistance exercise training. Titus does not teach apparatus or methods permitting strength exercises using a treadmill from a supine position.

As can be seen, the foregoing body of art does not provide for: (1) apparatus and methods to adapt a treadmill for strength training; (2) which allows continued use of the treadmill as a treadmill while attached; (3) which can be easily attached and detached; (4) which includes angular adjustments for the arms; (5) which includes articulated arms; (6) which utilizes straps with ratcheting/quick-release attachments to attach to a treadmill; (7) which can be used for upper body strength exercises from both a standing and a supine position; (8) which includes an exercise bench mountable over a treadmill.

SUMMARY AND ADVANTAGES

A treadmill conversion resistance training apparatus for a treadmill having left and right vertical support columns includes mirror-image left and right attachments for attaching to the treadmill left and right vertical support columns, each of the attachments having a vertical mounting bracket removably attachable to a treadmill vertical support column; a translation member rotatingly connectable to the vertical mounting bracket at a translation axis, the translation member having means for removably connecting one or more resistance straps; a handle connectable to the translation member; means for locking the handle at an adjustable angular orientation in relation to the translation member, such that moving the locked handle causes the translation member to rotate about the translation axis; and, one or more resistance straps removably connectable between the translation member and the vertical mounting bracket; wherein, the apparatus allows the exercise treadmill to continue to function as an exercise treadmill while the apparatus is attached to the exercise treadmill. A treadmill conversion apparatus includes a handle having an articulation joint, the joint having locking means for locking the joint at a selectable angle. A treadmill conversion apparatus includes a handle joint having adjustable resistance means.

A treadmill conversion resistance training apparatus, the treadmill including a forward end and an aft end, a treadway, and left and right vertical support columns, includes mirror-image left and right attachments for attaching to the treadmill left and right vertical support columns, wherein each of the attachments includes a vertical mounting bracket removably attachable around one of the treadmill vertical support columns, the vertical mounting bracket having opposing first and second bracket pieces, each of the first and second bracket pieces having a bottom edge, a top edge, a substantially "U"-shaped transverse cross-section including first and second extensions and a connecting bridge portion, and wherein the "U"-shaped cross-section forms an interior surface and an exterior surface; at least one clamping bolt engaging the first and second mounting bracket pieces; one or more retaining straps for bracing the vertical mounting bracket to a vertical support column; a resistance strap bottom anchor projecting outwardly from the exterior surface of the mounting bracket first piece, the anchor located proximal to the bottom edge of the vertical mounting bracket; a translation member comprising: a central mounting hole, a plurality of handle indexing holes distributed radially around the central mounting hole at selected angular offsets for indexed positioning of a handle, and a resistance strap connection point radially distal from the central mounting hole; a handle having an elongated shaft extending from a first connection end to a second grip end, a first handle mounting hole disposed proximal to the handle connection end, a second handle mounting hole disposed distally from the first handle mounting hole toward the handle grip end, wherein the distance between the first and second handle mounting holes matches the radial distance between the center mounting hole and the plurality of handle index holes of the translation member, and further wherein a portion of the handle near the second end is rounded to provide a hand grip; axel means for mounting the handle and the translation member to the mounting bracket first piece, wherein the axel means is attached to the mounting bracket first piece proximal to the top edge of the mounting bracket first piece and extends through the translation member central mounting hole and handle first mounting hole; a removable handle index pin for selectively locking the handle to the translation member through the handle second mounting hole and a selected handle index hole, such that the handle and the translation member rotate collectively about the axel means; and, one or more incremental resistance straps, each of the resistance straps connectable at a first end to the resistance strap anchor and at a second end to the translation member connection point; wherein, the conversion apparatus allows the exercise treadmill to continue to function as an exercise treadmill while the conversion apparatus is attached to the exercise treadmill. A treadmill conversion apparatus includes axel means having an axel bolt extending through the mounting bracket first piece, translation member central mounting hole, and handle first mounting hole. A treadmill conversion apparatus includes axel means having an axel post extending outwardly from the mounting bracket first piece, the axel post having an axial center through-hole, a rotational bearing mounted to the axel post, a center bolt, and a center bolt locking nut; wherein the translation member is rotatingly attachable to the axel post over the bearing, thereby engaging the bearing, and the center bolt extends through the center through-hole and the handle first mounting hole and engages the center bolt locking nut. A treadmill conversion apparatus includes a portable exercise bench able to fit over the treadmill treadway, and further includes a bench collapsible for storage.

A treadmill conversion resistance training apparatus for converting an exercise treadmill for strength training, said treadmill having left and right vertical support columns and a treadway, has left and right resistance attachments removably attachable to the treadmill left and right vertical columns, wherein each of the resistance attachments includes a mounting bracket removably attachable to a treadmill vertical support column; a translation member removably and rotatingly attachable to the mounting bracket; an articulated handle connectable to the translation member at an adjustable angle, the handle having a first part and a second part and a joint connecting the first and second part, wherein the handle first part is further connectable to the translation member at an adjustable angle to the translation member, and wherein the joint includes means for locking the handle second part at a selectable angle to the handle first part, and wherein the handle second part further includes a hand grip; and, one or more resistance straps connectable between the translation member and the mounting bracket. A treadmill conversion apparatus handle joint may include adjustable rotational resistance means. A treadmill conversion apparatus includes a bench able to fit over said treadmill treadway, and further includes a bench collapsible for storage. A treadmill conversion apparatus includes an articulated handle joint having adjustable resistance means comprising one or more friction disks. A treadmill conversion apparatus includes mounting brackets having first and second opposing bracket pieces matable around a vertical column of the treadmill. A treadmill conversion apparatus includes the resistance attachments having one or more retaining straps connectable around the mounting bracket.

The treadmill conversion strength training apparatus of the present invention presents numerous advantages, including: (1) apparatus and methods to adapt a treadmill for strength training; (2) which allows continued use of the treadmill as a treadmill while attached; (3) which can be easily attached and detached; (4) which includes angular adjustments for the arms; (5) which includes articulated arms; (6) which utilizes straps with ratcheting/quick-release attachments to attach to a treadmill; (7) which can be used for upper body strength exercises from both a standing and a supine position; (8) which includes an exercise bench mountable over a treadmill.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

REFERENCE NUMBERS FOR DRAWINGS

Figure 1:
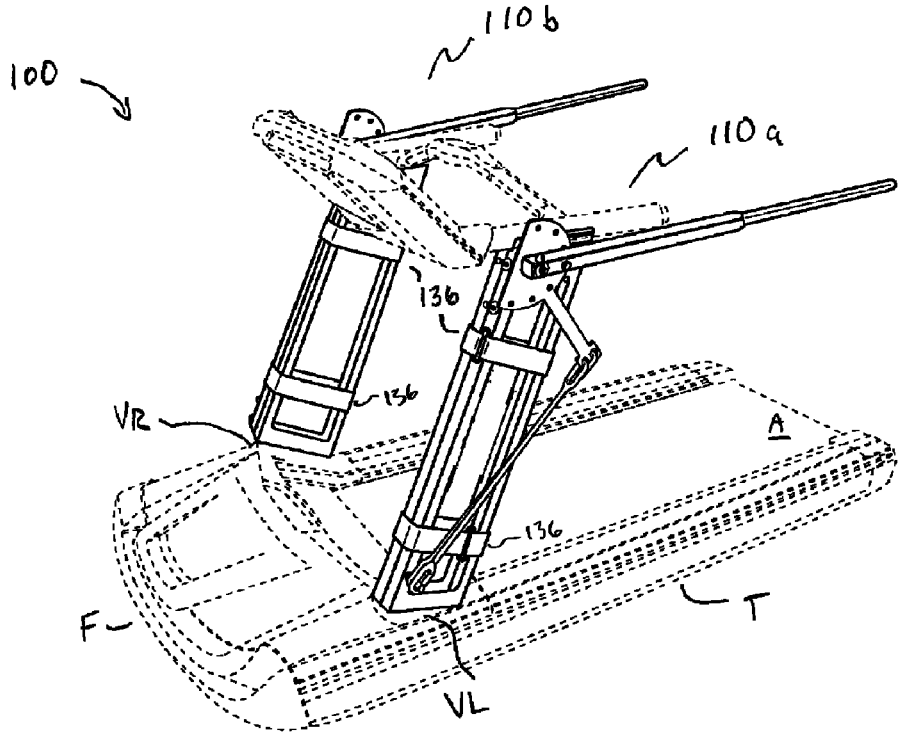
FIG. 1 shows a front perspective view of a first embodiment of the invention.
Figure 2:
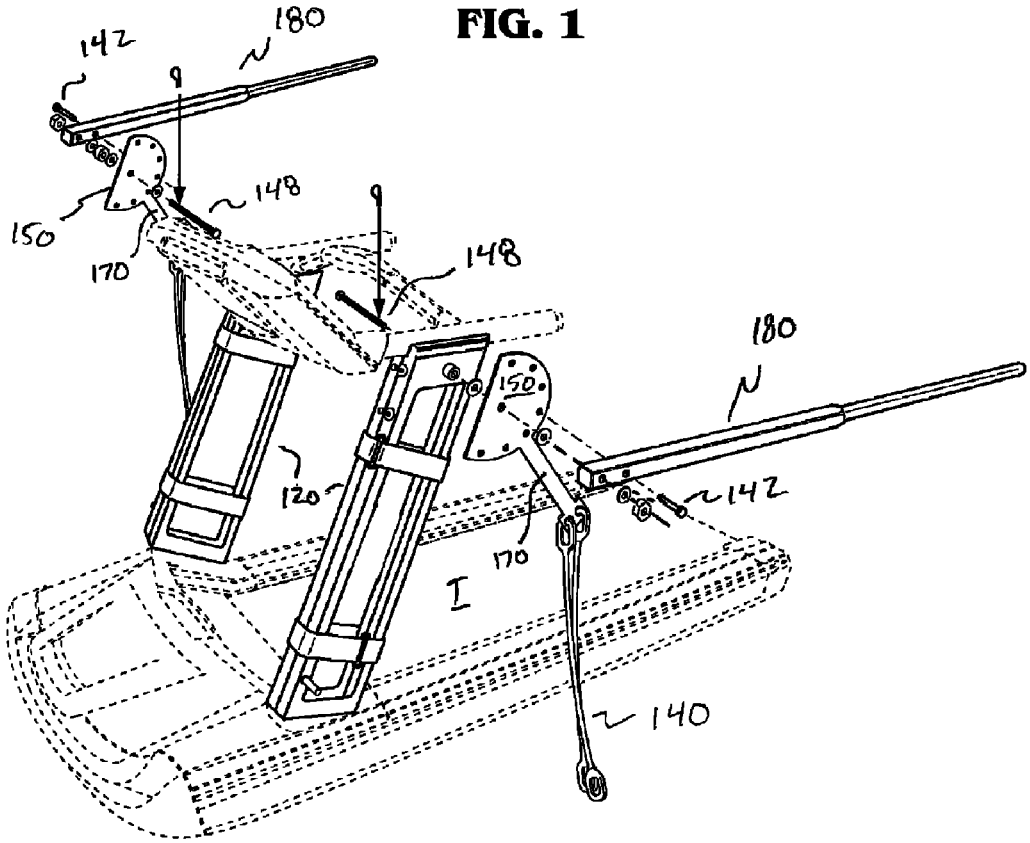
FIG. 2 shows a partially exploded view of a first embodiment of the invention.
Figure 3:
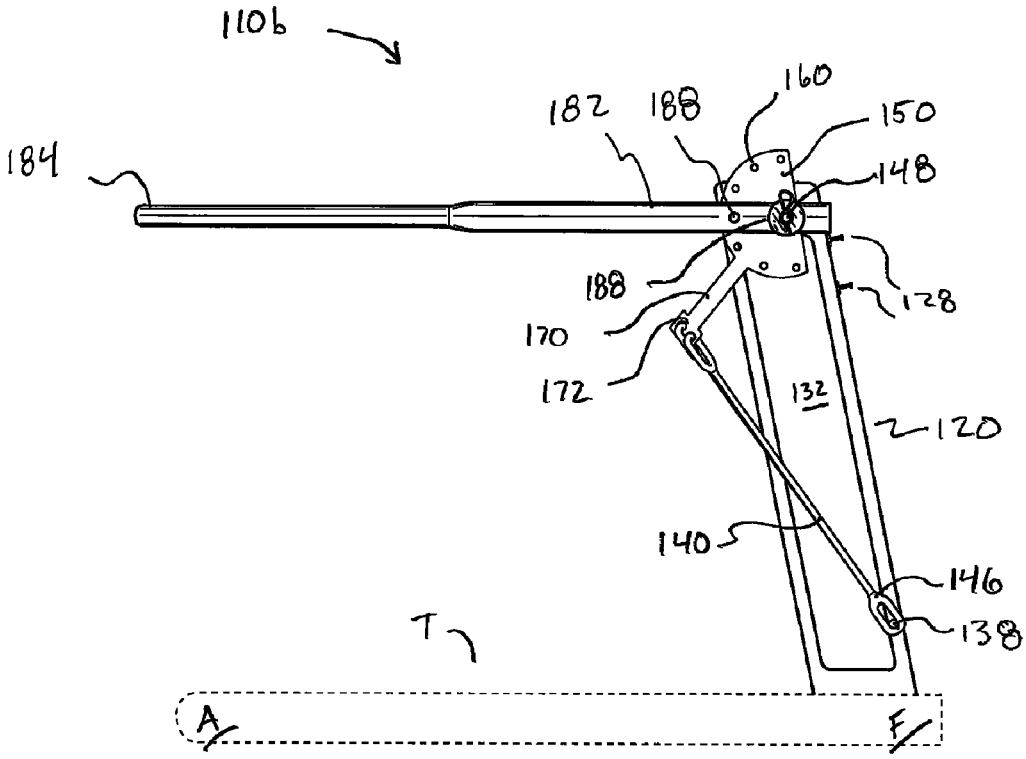
FIG. 3 shows a side view of a first embodiment of the invention.

The following list of reference numbers used in the Detailed Description and Drawings, is provided for convenience:

| | |
|---|---|
| 100 | First Embodiment |
| 102 | Mounting Bracket First Piece Interior Surface |
| 103 | Mounting Bracket Second Piece Interior Surface |
| 104 | Mounting Bracket First Piece First Extension |
| 106 | Mounting Bracket First Piece Second Extension |
| 108 | Mounting Bracket Second Piece First Extension |
| 109 | Mounting Bracket Second Piece Second Extension |
| 110 | Resistance Attachment |
| 110a | Left Resistance Attachment |
| 110b | Right Resistance Attachment |
| 112 | Mounting Bracket First Piece Top Edge |
| 114 | Mounting Bracket First Piece Bottom Edge |
| 116 | Mounting Bracket Second Piece Top Edge |
| 118 | Mounting Bracket Second Piece Bottom Edge |
| 120 | Mounting Bracket |

-continued

| | |
|---|---|
| 122 | Mounting Bracket First Piece |
| 124 | Mounting Bracket Second Piece |
| 126 | Mounting Bracket Slotted Holes |
| 128 | Mounting Bracket Threaded Tighteners |
| 132 | Mounting Bracket Cutout |
| 134 | Translation Member Connection Point |
| 136 | Securing Straps |
| 138 | Resistance Strap Anchor |
| 140 | Resistance Straps |
| 142 | Index Pin |
| 144 | Resistance Strap First End |
| 146 | Resistance Strap Second End |
| 148 | Axel Bolt |
| 150 | Translation Member |
| 151 | Axel Bolt Lock Nut |
| 152 | Central Mounting Hole |
| 154 | Washer |
| 160 | Index Holes |
| 170 | Translation Member Arm |
| 172 | Resistance Strap Connection Points on Lever Arm |
| 180 | Handle |
| 182 | Handle First Connection End |
| 184 | Handle Second Grip End |
| 186 | Handle First Mounting Hole |
| 188 | Handle Second Mounting Hole |
| 200 | Exercise Bench |
| 1000 | Second Embodiment |
| 1010 | Resistance Attachment |
| 1010a | Left Resistance Attachment |
| 1010b | Right Resistance Attachment |
| 1020 | Mounting Bracket |
| 1020a | Left Mounting Bracket |
| 1020b | Right Mounting Bracket |
| 1022 | Mounting Bracket First Part |
| 1024 | Mounting Bracket Second Part |
| 1026 | Mounting Bracket Slotted Holes |
| 1028 | Mounting Bracket Threaded Tightener |
| 1034 | Translation Member Connection Point |
| 1036 | Securing Straps |
| 1038 | Resistance Strap Anchor |
| 1039 | Anchor Mounting Hole |
| 1040 | Resistance Strap |
| 1041 | Resistance Strap Anchor Lock Washer |
| 1042 | Removable Locking Pins |
| 1044 | Resistance Strap First End |
| 1046 | Resistance Strap Second End |
| 1048 | Axel Bolt |
| 1050 | Translation Member |
| 1051 | Axel Bolt Lock Nut |
| 1052 | Translation Member First Plate |
| 1053 | First Plate Center Hole |
| 1054 | Translation Member Second Plate |
| 1055 | Second Plate Center Hole |
| 1056 | Translation Member Spacers |
| 1058 | Translation Member Bolts |
| 1059 | Translation Member Lock Nuts |
| 1060 | First Plate Index Holes |
| 1062 | Second Plate Index Holes |
| 1080 | Handle |
| 1082 | Handle First Part |
| 1084 | Handle First Part Index Hole |
| 1085 | Handle First Part Index Hole |
| 1086 | Handle First Part Mounting Hole |
| 1088 | Handle Second Part |
| 1090 | Handle Joint |
| 1092 | Handle Joint First Plate |
| 1094 | Handle Joint Second Plate |
| 1096 | Handle Joint First Plate Index Holes |
| 1098 | Handle Joint Second Plate Index Holes |
| 1100 | Handle Joint First Plate Center Mounting Hole |
| 1102 | Handle Joint Second Plate Center Mounting Hole |
| 1104 | First Friction Disk |
| 1106 | Second Friction Disk |
| 1108 | Handle Second Part Mounting Hole |
| 1110 | Handle Second Part Index Hole |
| 1112 | Hand Grip |
| 1116 | Handle Joint Axel Bolt |
| 1120 | Flexible Straps |
| T | Exercise Treadmill |
| F | Exercise Treadmill Front End |

-continued

| | |
|---|---|
| A | Exercise Treadmill Aft End |
| VL | Exercise Treadmill Left Vertical Support |
| VR | Exercise Treadmill Right Vertical Support |

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

For ease of reference a common identification system is used herein for describing the disclosed embodiments. An exercise treadmill as used in this Specification is defined to include a treadway, which the exerciser walks upon during use, a front end, which is the end the exerciser faces when walking forward, and a back end, which is open for the exerciser to enter the treadmill. The invention disclosed includes mirror image left-side and right-side attachments for mounting to left and right vertical supports of an exercise treadmill. "Mirror-image" includes where the left and right-side attachments are actually identical and interchangeable. For clarity, in this Specification, left-side components are described using "a" suffices, right-side components are described using "b" suffices, to indicate their correspondence, and the corresponding left-side and right-side components are referred to collectively without the suffix. For example, referring to FIG. 1, the left-side resistance attachment is identified as 10*a*, the right-side resistance attachment is identified as 10*b*, and the treadmill conversion apparatus as a whole is identified as 10. Subcomponents are referred to without lettering as they are redundant.

A treadmill conversion resistance training apparatus for a treadmill having left and right vertical support columns includes mirror-image left and right attachments for attaching to the treadmill left and right vertical support columns, each of the attachments having a vertical mounting bracket removably attachable to a treadmill vertical support column; a translation member rotatingly connectable to the vertical mounting bracket at a translation axis, a handle connectable to the translation member and lockable at selected angles; and, one or more resistance straps removably connectable between the translation member and the vertical mounting bracket; wherein, the apparatus allows the exercise treadmill to continue to function as an exercise treadmill while the apparatus is attached to the exercise treadmill. A treadmill conversion apparatus includes a handle having an articulation joint lockable at selectable angles. A treadmill conversion apparatus includes a handle joint having adjustable resistance means.

A treadmill conversion resistance training apparatus, the treadmill including a forward end and an aft end, a treadway, and left and right vertical support columns, includes mirror-image left and right attachments for attaching to the treadmill left and right vertical support columns, wherein each of the attachments includes a vertical mounting bracket removably attachable around one of the treadmill vertical support columns, the vertical mounting bracket having opposing first and second bracket pieces, each of the first and second bracket pieces having a bottom edge, a top edge, a substantially "U"-shaped transverse cross-section including first and second extensions and a connecting bridge portion, and wherein the "U"-shaped cross-section forms an interior surface and an exterior surface; at least one clamping bolt engaging the first and second mounting bracket pieces; one or more retaining straps for bracing the vertical mounting bracket to a vertical support column; a resistance strap bottom anchor projecting outwardly from the exterior surface of the mounting bracket first piece, the anchor located proximal to the bottom edge of the vertical mounting bracket; a translation member comprising: a central mounting hole, a plurality of handle indexing holes distributed radially around the central mounting hole at selected angular offsets for indexed positioning of a handle, and a resistance strap connection point radially distal from the central mounting hole; a handle having an elongated shaft extending from a first connection end to a second grip end, a first handle mounting hole disposed proximal to the handle connection end, a second handle mounting hole disposed distally from the first handle mounting hole toward the handle grip end, wherein the distance between the first and second handle mounting holes matches the radial distance between the center mounting hole and the plurality of handle index holes of the translation member, and further wherein a portion of the handle near the second end is rounded to provide a hand grip; an axel for mounting the handle and the translation member to the mounting bracket first piece, wherein the axel is attached to the mounting bracket first piece proximal to the top edge of the mounting bracket first piece and extends through the translation member central mounting hole and handle first mounting hole; a removable handle index pin for selectively locking the handle to the translation member through the handle second mounting hole and a selected handle index hole, such that the handle and the translation member rotate collectively about the axel; and, one or more incremental resistance straps, each of the resistance straps connectable at a first end to the resistance strap anchor and at a second end to the translation member connection point; wherein, the conversion apparatus allows the exercise treadmill to continue to function as an exercise treadmill while the conversion apparatus is attached to the exercise treadmill. A treadmill conversion apparatus includes an axel having an axel bolt extending through the mounting bracket first piece, translation member central mounting hole, and handle first mounting hole. A treadmill conversion apparatus includes an axel having an axel post extending outwardly from the mounting bracket first piece, the axel post having an axial center through-hole, a rotational bearing mounted to the axel post, a center bolt, and a center bolt locking nut; wherein the translation member is rotatingly attachable to the axel post over the bearing, thereby engaging the bearing, and the center bolt extends through the center through-hole and the handle first mounting hole and engages the center bolt locking nut. A treadmill conversion apparatus includes a portable exercise bench able to fit over the treadmill treadway, and further includes a bench collapsible for storage.

A treadmill conversion resistance training apparatus for converting an exercise treadmill having left and right vertical support columns and a treadway is provided, including left and right resistance attachments removably attachable to the treadmill left and right vertical columns, wherein each of the resistance attachments includes a mounting bracket removably attachable to a treadmill vertical support column; a translation member removably and rotatingly attachable to the mounting bracket; an articulated handle connectable to the translation member at an adjustable angle, the articulated handle having a first part and a second part and an articulation joint connecting the first and second part, wherein the articulated handle first part is further connectable to the translation member at an adjustable angle to the translation member, and wherein the joint includes a locking part for locking the handle second part at a selectable angle to the handle first part, and wherein the handle second part further includes a hand grip; and, one or more resistance straps connectable between the translation member and the mounting bracket. A treadmill conversion apparatus articulation joint may include an adjustable rotational resistance portion. A treadmill conversion apparatus includes a bench able to fit over said treadmill treadway, and further includes wherein the bench is collapsible for storage. A treadmill conversion apparatus includes an articulated handle joint having adjustable resistance portion having one or more friction disks. A treadmill conversion apparatus includes mounting brackets having first and second opposing bracket pieces matable around a vertical column of the treadmill. A treadmill conversion apparatus includes the resistance attachments having one or more retaining straps connectable around the mounting bracket.

Referring to FIGS. 1-5, in a first embodiment a treadmill conversion resistance training apparatus 100 is provided for a treadmill T having left and right vertical support columns VL and VR, respectively, a forward end F and an aft end A. Treadmill conversion apparatus 100 includes mirror-image left and right attachments 110*a* and 110*b*, respectively, for attaching to the treadmill left and right vertical support columns VL and VR. Each of the resistance attachments 110*a* and 110*b* has a vertical mounting bracket 120*a* and 120*b* removably attachable to treadmill vertical support columns VL and VR. Resistance attachments 110*a* and 110*b* are mirror images of each other and include redundant components, so will be described generically.

Mounting brackets 120*a* and 120*b* provide a structure to mount the moving resistance elements of the system to an existing treadmill.

Referring again to FIGS. 1-5, in a first embodiment a resistance attachment 110 includes a vertical mounting bracket 120, a translation member 150 rotatingly connectable to vertical mounting bracket 120 at a connection point 134. Vertical mounting bracket 120 includes opposing first and second bracket pieces 122 and a piece 124 for mounting around vertical support columns VL and VR. Each of first and second bracket pieces 122 and 124 have a top edge 112 and 116, respectively, and a bottom edge 114 and 118, respectively. Each of mounting bracket pieces 122 and 124 includes cutouts 132 to reduce weight. Mounting bracket pieces 122 and 124 are generally U-shaped in cross section with first extensions 104 and 108, respectively, and second extensions 106 and 109, respectively, creating interior surfaces 102 and 103, respectively, and outer surfaces 105 and 107, respectively. At least one, clamping bolt 128 is provided which engages mounting bracket first piece 122 through slotted hole 126 in mounting bracket second piece extension 104. Preferably two clamping bolts each are provided at the forward and aft of each vertical mounting brackets 120. Retaining straps 136 are provided to help assemble and stabilize mounting brackets 120. Anchor 138 extends outwardly from the outer surface 105 of mounting bracket first piece 122 proximal to bottom edge 114. Preferably anchor 138 is a fixed threaded post.

Connection point 134 extending outwardly from mounting bracket first piece 122 and located proximal to top edge 112, receives axel bolt 148 defining a translation axis about which translation member 150 and handle 180 rotate. In the disclosed embodiment connection point 134 is a short cylinder welded to mounting bracket first part 122. Translation member 150 has connector 172 for removably connecting one or more resistance straps 140. Handle 180 is connectable to translation member 150. Handle 180 is preferably an elongated shaft having first end 182 and second end 184. Handle second end 184 provides a hand grip. Handle 180 has a first mounting hole 186 for removably connecting to translation member 150 by receiving axel bolt 148 there through and a second mounting hole 188 for receiving an index locking pin 142 there through. In the disclosed embodiment lock nut 151 retains handle 180 and translation member 150. Washer 154 is provided between translation member 150 and connection point 134. Alternatively washer 154 may be replaced by a rotational bearing mounted onto connection point 134. Axel bolt 148 may be removable or alternatively a fixed axel. Handle 180 may be articulated.

Handle 180 can be locked at an adjustable angular orientation in relation to the translation member 150, such that moving the locked handle 180 causes the translation member 150 to rotate about the translation axis 134. In the disclosed embodiment translation member 150 includes a plurality of index holes 160 disposed radially about central mounting hole 152 at pre-selected angular offsets. The distance between handle first mounting hole 186 and handle second mounting hole 188 is equal to the distance between center mounting hole 152 and index holes 160. Receiving hooks 172 are provided for removably connecting one or more resistance straps 140 to translation member 150 at a point radially distant from center mounting hole 152. Translation arm 170 extends radially outward from translation member 150 to provide a connection point with a greater range of motion while maintaining translation member 150 relatively compact.

One or more resistance straps 140 removably connectable between the translation member 150 and the vertical mounting bracket 120. Each of resistance straps 140 include a first end 144 connectable to receiving hook 172 and a second end 146 connectable at anchor 138. Resistance straps 140 provide incremental resistance for exercises, with the user selecting the number and type of resistance straps 140 depending on their ability and desired intensity of their workout.

Figure 4:
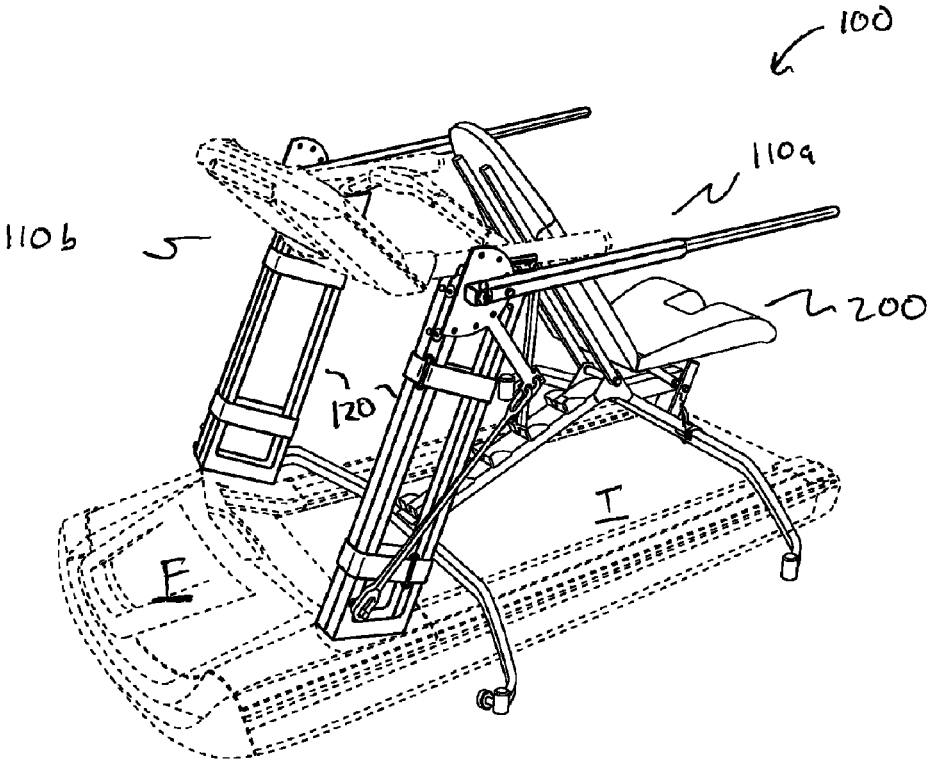
FIG. 4 shows front perspective view of a first embodiment of the invention with an articulated bench.
Figure 5:
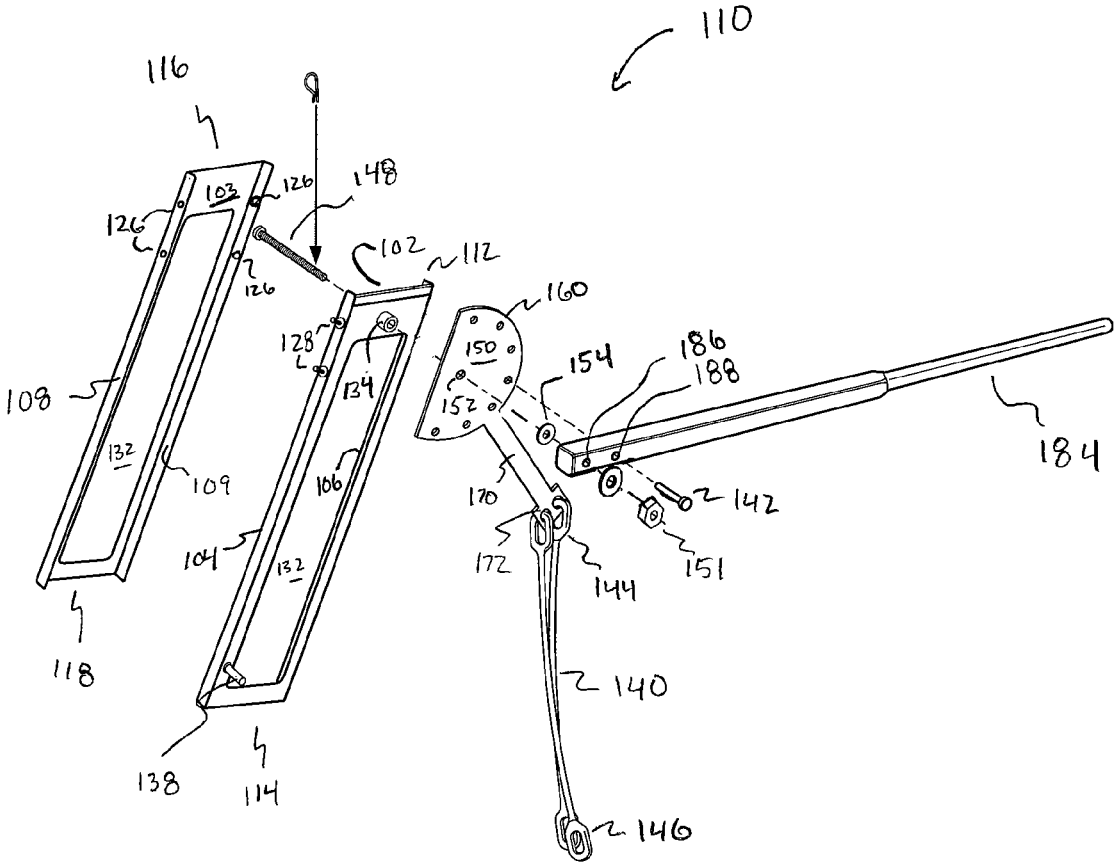
FIG. 5 shows an exploded view of a resistance attachment of a first embodiment of the invention.

Referring to FIG. 4, a treadmill conversion apparatus preferably includes an exercise bench 200 which fits over treadmill T treadway, to allow for exercising from the supine or sitting positions. Alternatively, a user could simply lay or sit on the treadway.

Treadmill conversion apparatus 100 allows the exercise treadmill T to continue to function as an exercise treadmill while the apparatus 100 is attached to the exercise treadmill T. A treadmill conversion apparatus 100 includes a handle having an articulation joint, the joint having a locking portion 196 & 198 for locking the joint at a selectable angle. A treadmill conversion apparatus includes a handle joint having adjustable resistance portion.

Referring to FIGS. 6-9, a second embodiment of a system 1000 for converting an exercise treadmill T, having a forward end F, and aft end A, and left and right vertical support columns VL and VR, respectively, for strength training, is shown, and includes left and right attachments, 1010*a* and 1010*b*, respectively, where each attachment 1010*a* and 1010*b* has a mounting bracket 1020*a* and 1020*b*, respectively, removably attachable to a support column VR or VL. Mounting brackets 1020*a* and 1020*b* are mirror images of each other and each may be attachable to either support column VR or VL, depending on the configuration preferred by the user. In the disclosed embodiment, mounting brackets 1020*a* and 1020*b* are attached with bracket 1020*a* attached to left column VL and 1020*b* attached to right column VR, for inside mounting of translation members 1050. Alternatively, for a treadmill T with a more narrow spacing of vertical support columns, mounting bracket 1020*a* may be mounted to right column VR and mounting bracket 1020*b* may be mounted to left column VL, to provide outside mounting of translation members 1050. While mounting brackets 1020*a* and 1020*b* are mirror images, all other components in the disclosed embodiment are interchangeable on the left and right sides, and so only one attachment 1010 is shown in detail for explanation in FIGS. 7-9.

Referring to FIG. 6, and FIGS. 7-9, an attachment 1010 includes a vertical mounting bracket 1020 removably attachable to a treadmill vertical support column VL or VR, a translation member 1050 rotatingly connectable to a mounting bracket 1020, articulated handle 1080 connectable to translation member 1050, and one or more resistance straps 1040 connectable between mounting bracket 1020 and translation member 1050.

Figure 6:
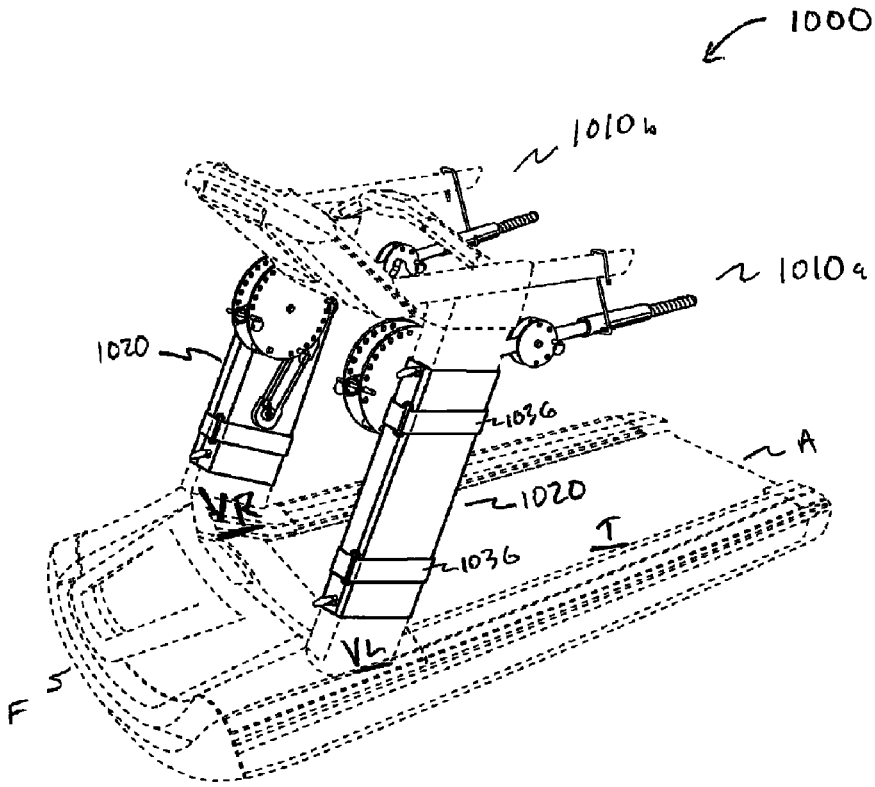
FIG. 6 shows a front perspective view of a second embodiment of the invention.
Figure 7:
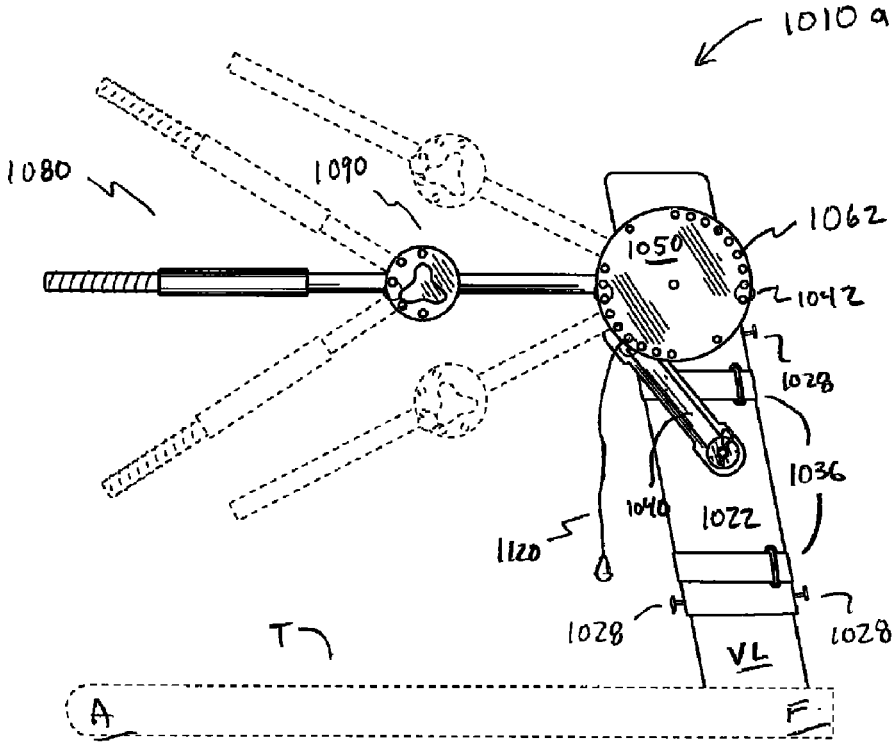
FIG. 7 shows a side cut-away view of a second embodiment of the invention, indicating the nature of movement.
Figure 8:
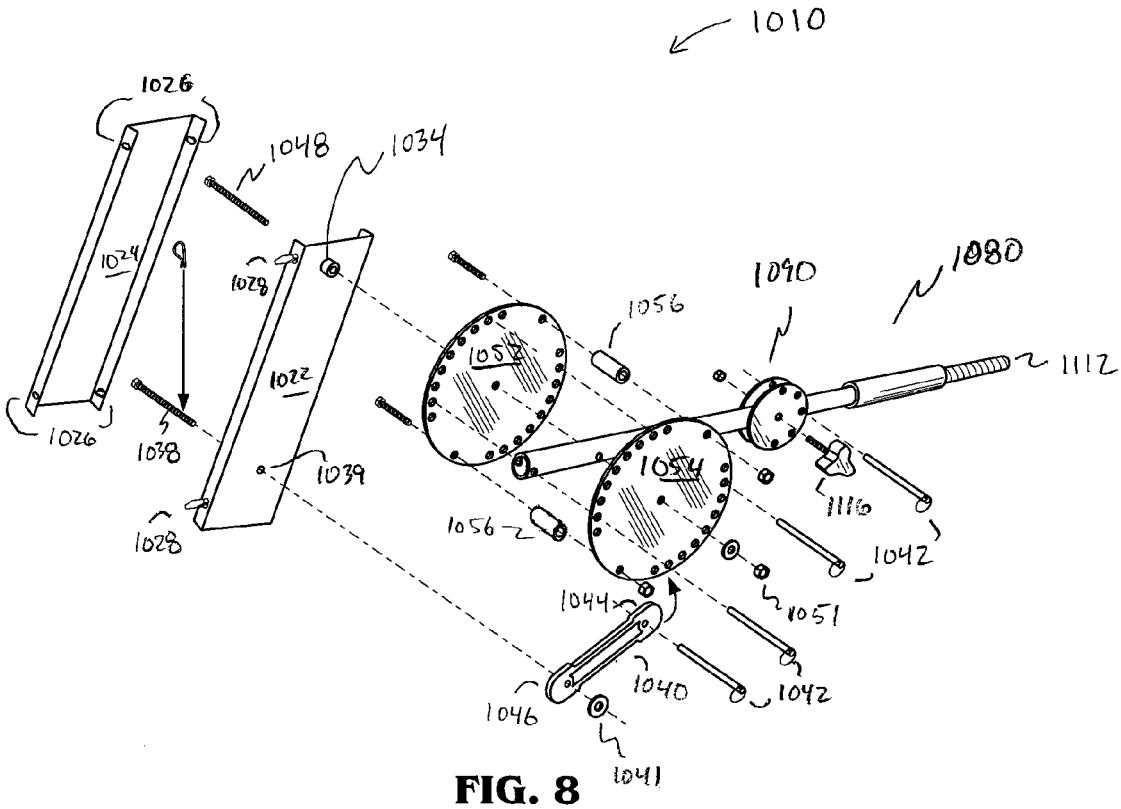
FIG. 8 shows an exploded view of a resistance attachment of a second embodiment of the invention.

Referring to FIGS. 6-8, mounting bracket 1020 includes a first part 1022 matable to a second part 1024 about a treadmill vertical column VR or VL. Threaded tighteners 1028 extend through slotted holes 1026 in second part 1024 to engage threaded receiving holes on first part 1022 in order to secure mounting bracket 1020 around a vertical support column VR or VL. Mounting bracket 1020 may include additional threaded tighteners 1028 on the opposing side as well. Referring to FIGS. 6 and 7, adjustable securing straps 1036 are provided to assist in securing vertical mounting brackets 1020*a* and 1020*b* to treadmill vertical support columns VR and VL. Preferably two adjustable securing straps 1036 are provided for each mounting bracket 1020*a* & *b*, one for top and one for bottom.

Referring again to FIG. 8, mounting bracket 1020 includes a connection point 1034 for rotatably and removably connecting translation member 1050. Axel bolt 1048 extends through connection point 1034 and translation member 1050 to provide the axis of rotation for translation member 1050, and is secured using a locking nut and washer set 1051. Alternatively, axel bolt 1048 may be a fixed threaded axel. A rotational bearing for engaging translation member 1050 may be mounted over connection point 1034 or axel bolt 1048 to reduce friction and assist in distributing torque loads. Mounting bracket 1020 includes anchor 1038 with locking pin and washer 1041 for connecting resistance straps 1040 to mounting bracket 1020. Preferably axel bolt 1048 and anchor 1038 are mounted from the inside of mounting bracket 1020 oriented outward, so that a user does not have to drill through treadmill support columns VR and VL to attach the vertical mounting bracket 1020. Alternatively, anchor 1038 may be a fixed bolt or post.

Figure 9:
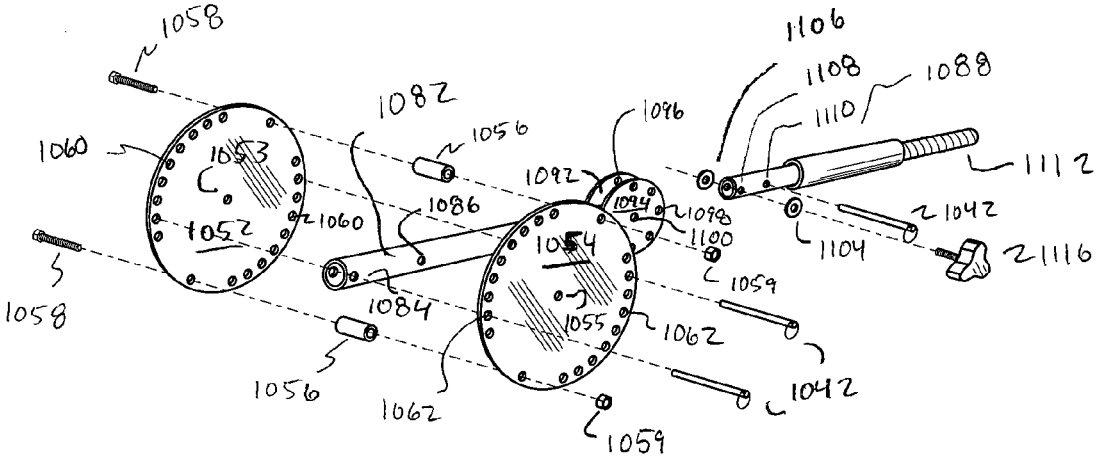
FIG. 9 shows an exploded view of a translation member and articulated handle of a second embodiment of the invention.

Referring to FIGS. 8 and 9, translation member 1050 includes opposing first and second plates 1052 and 1054, respectively, which are bolted together via spacers 1056 and bolts 1058 with locking nuts 1059. Matching index holes 1060 and 1062 are distributed radially about center mounting holes 1053 and 1055 for locking articulated handle 1080 at the desired angular orientation to translation member 1050 using a pair of locking pins 1042.

Articulated handle 1080 includes a first part 1082 connectable to translation member 1050 at a selected angular orientation to translation member 1050 and a second part 1088 rotatingly connected to handle first part 1082 at joint 1090. Handle first part 1082 includes handle first part mounting hole 1086 for receiving axel bolt 1048, and handle first part indexing holes 1084 and 1085 for receiving removable locking pins 1042 when aligned with index holes 1060 and 1062. Articulation joint 1090 includes first and second joint plates 1092 and 1094, respectively, fixed on opposing sides of hand first part 1082 and having matching joint index holes 1096 and 1098 and center mounting holes 1100 and 1102 (1102 not visible in the views), and first and second friction disks 1104 and 1106. Handle second part 1088 has a mounting hole 1108, index hole 1110 and hand grip 1112. When assembled, handle second part 1088 fits between first and second joint plates 1092 and 1094. First and second friction disks 1104 and 1106 fit into the spaces between handle second part 1088 and first and second joint plates 1092 and 1094. Handle second part mounting hole 1108 and friction disks 1104 and 1106 align with joint plate center mounting holes 1100 and 1102 to receive joint axel bolt 1116. Preferably joint axel bolt 1116 includes a knurled or petalled handle grip for ease of use. An index locking pin 1042 is provided to engage joint index holes 1096 and 1098 with handle second part index hole 1110, thereby allowing handle second part 1088 to be locked in a desired angular orientation to handle first part 1082. Alternatively, with index pin 1042 removed, handle second part 1088 may be rotated about joint 1090 for exercise, with friction resistance provided by friction disks 1104 and 1106. Preferably friction disks 1104 and 1106 are made from plastic material such as nylon for ease of manufacture and minimal expense, as they will wear over time, but any suitable material may be used.

One or more resistance straps 1040 are provided for connecting between mounting bracket 1020 and translation member 1050. Resistance strap 1040 connects at a first end 1044 to mounting bracket 1020 via anchor 1038 and at a second end 1046 to translation member 1050 using a locking pin 1042 through translation member index holes 1060 and 1062. Resistance strap 1040 is preferably made from a strong stretchable material such as butyl rubber, but other stretchable materials such as silicone rubber or other suitable materials could be used. Additionally, flexible straps 1120 may be attached to translation member 1050 using a locking pin through index holes 1060 and 1062 in order to increase the range of exercises available. In the disclosed embodiment flexible straps 1120 are bungee cords or surgical tubing.

Referring to FIGS. 6-9, in operation the second embodiment, a user begins by assembling and mounting the conversion apparatus to a treadmill. Assembly involves inserting axel bolt 1048 and anchor 1038 through connection point 1034 and hole 1039 (if not permanently mounted), respectively, then mounting the attachments 1010*a* and 1010*b* around respective treadmill vertical support columns VR and VL by sandwiching first and second mounting bracket parts 1022 and 1024 around each of vertical support columns VR and VL, tightening adjustable securing straps 1036 to hold them tightly, and threading locking handles 1028 through slotted holes 1026 to lock first and second parts 1022 and 1024 in place. Articulated handle 1080 is inserted into translation member 1050 and aligned at a desired angle, and locking pins 1042 are inserted through index holes 1060, 1062, 1084 and 1085. Translation member 1050, with handle 1080 mounted therein, is attached to connection point 1034 using axel bolt 1048 and locking nut and washer 1051. Locking nut and washer 1051 lock to prevent backing off axel bolt 1048, but do not lock translation member 1050 from rotation. Translation member 1050 is free to rotate about axel bolt 1048.

Resistance strap 1040 is connected at first end 1044 using anchor 1038, and at a second end 1046 to translation member 1050 using a locking pin 1042. Resistance strap 1040 may be connected at any of the indexing holes 1060 and 1062, thereby allowing a user to accommodate straps of differing length. The user may also selectively adjust the angle of handle 1080 by selecting different index holes 1060 and 1062, to accommodate different user heights or different ranges of motion. Use of additional resistance straps 1040 allows incremental increase in resistance and therefore the intensity of exercises. Attaching resistance strips 1040 to translation member 1050 at a radial distance from axel bolt 1048 provides a smooth, essentially linear resistance profile. Resistance strap 1040 could also be attached to handle 1080 and function adequately. A plurality of resistance straps 1040 may be connected between anchor 1038 and opposing sides of translation member 1050 to provide resistance in both directions.

Articulated handle joint 1090 allows a user to lock handle 1080 at a selected angle in order to utilize resistance straps 1040 for exercise, or to unlock handle joint handle joint 1090 and use handle 1080 for resistance exercising. Resistance of handle joint 1090 to rotation is adjustable by adjusting the tightness of joint axel bolt 1116—i.e. tightening joint axel bolt 1116 compresses joint plates 1092 and 1094 against friction disks 1104 and 1106, thereby increasing resistance, while loosening joint axel bolt 1116 reduces resistance.

A user may utilize articulated bench 200, shown in FIG. 4, placed over treadway T in order to perform bench presses, shoulder presses, and other traditional strength exercises from a supine, prone, or sitting position. Alternatively, a user could lay a pad directly on treadway T and lie or sit on the pad to perform exercises.

Referring to FIG. 7, the nature of movement of the translation member 1050 and articulated handle joint 1090 are shown by hidden lines. Varying the angle of handle 1080, and/or the connection point of resistance strap 1040 to translation member 1050, and/or the model of resistance strap 1040, and/or the angle of joint 1090, and/or the rotational resistance of joint 1090, allows the treadmill resistance training apparatus to accommodate a wide range of user heights, abilities, and exercises of various ranges of motion and resistance profiles.

The treadmill resistance training apparatus 1000 is easily removable by reversing the attachment steps described above. A user may choose to simply leave the resistance training apparatus attached, as the apparatus does not interfere with the normal operation of the treadmill.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

We claim:

1. A treadmill conversion resistance training apparatus for a treadmill having left and right vertical support columns, said apparatus comprising mirror-image left and right attachments for attaching to said treadmill left and right vertical support columns, each of said attachments comprising:

a vertical mounting bracket removably attachable to a treadmill vertical support column;

a translation member rotatingly connectable to said vertical mounting bracket at a translation axis;

an elongated handle having a first end and a distal user-engageable second end, said handle connected to said translation member proximal to said first end and lockable to said translation member at selected angles relative to said translation member, such that said handle is pivotable about said translation axis in a vertical plane substantially parallel to the front-to-back axis of said treadmill;

one or more resistance straps removably connectable between said translation member and said vertical mounting bracket;

wherein, said apparatus allows said exercise treadmill to continue to function as an exercise treadmill while said apparatus is attached to said exercise treadmill.

2. A conversion apparatus as in claim 1, wherein said handle includes an articulation joint parallel with said translation member lockable at selectable angles.

3. A conversion apparatus as in claim 2, wherein said articulation joint includes adjustable resistance means.

4. A treadmill conversion resistance training apparatus, said treadmill including a forward end and an aft end, a treadway, and left and right vertical support columns, wherein said system includes mirror-image left-side and right-side attachments for attaching to said treadmill left and right vertical support columns, respectively, each of said attachments comprising:

a vertical mounting bracket removably attachable around one of said treadmill vertical support columns, said vertical mounting bracket having opposing first and second bracket pieces, each of said first and second bracket pieces having a bottom edge, a top edge, a substantially "U"-shaped transverse cross-section including first and second extensions and a connecting bridge portion, and wherein said "U"-shaped cross-section forms an interior surface and an exterior surface;

at least one clamping bolt engaging said first and second mounting bracket pieces;

one or more retaining straps for bracing said vertical mounting bracket to said vertical support column;

a resistance strap bottom anchors projecting outwardly from the exterior surface of said mounting bracket first piece, said anchor located proximal to said bottom edge of said vertical mounting bracket;

a translation member comprising: a central mounting hole, a plurality of handle indexing holes distributed radially around said central mounting hole at selected angular offsets for indexed positioning of a handle, and a resistance strap connection point radially distal from said central mounting hole;

a handle comprising: an elongated shaft extending from a first connection end to a second grip end, a first handle mounting hole disposed proximal to said handle connection end, a second handle mounting hole disposed distally from said first handle mounting hole toward said handle grip end, wherein the distance between said first and second handle mounting holes matches the radial distance between said center mounting hole and said plurality of handle index holes of said translation wheel, and further wherein a portion of said handle near said second end is rounded to provide a hand grip;

an axel means disposed proximal to said top edge and extending through said translation member central mounting hole and handle first mounting hole;

a removable handle index pin for selectively locking said handle to said translation member through said handle second mounting hole and a selected handle index hole, such that said handle and said translation wheel rotate collectively about said axel means; and, a plurality of incremental resistance straps, each of said resistance straps connectable at a first end to said resistance strap anchor and at a second end to said resistance strap connection point;

wherein, said apparatus allows said exercise treadmill to continue to function as an exercise treadmill while said apparatus is attached to said exercise treadmill.

5. The treadmill conversion apparatus of claim 4, wherein said axel means comprises:

an axel bolt extending through said mounting bracket first piece, translation member central mounting hole, and handle first mounting hole.

6. The treadmill conversion apparatus of claim 4, wherein said axel means comprises:

an axel post extending outwardly from said mounting bracket first piece, said axel post having an axial center through hole, a rotational bearing mounted to said axel post, a center bolt, and a center bolt locking nut;

wherein said translation member is rotatingly attachable to said axel post over said bearing, thereby engaging said bearing, and said center bolt extends through said center through hole and said handle first mounting hole and engages said center bolt locking nut.

7. The treadmill conversion apparatus of claim 4, further including a portable exercise bench able to fit over said treadmill treadway.

8. The treadmill conversion apparatus of claim 7, wherein said bench is collapsible for storage.

9. A treadmill conversion resistance training apparatus for converting an exercise treadmill for strength training, said treadmill having left and right vertical support columns and a treadway, said conversion apparatus comprising left and right resistance attachments removably attachable to said treadmill left and right vertical columns, wherein each of said resistance attachments includes:

a mounting bracket removably attachable to a treadmill vertical support column;

a translation member removably attachable to said mounting bracket and rotatable about a translation axis in a vertical plane substantially parallel to the front-to-back axis of said treadmill;

an articulated handle having a elongated first and a second parts and an articulation joint parallel with said translation member connecting said first and second parts, said handle second part having a hand grip distal from said articulation joint, wherein said handle first part is lockingly connectable to said translation member at adjustable angles to said translation member, and further wherein said articulation joint includes means for locking said handle second part at a selectable angle to said handle first part; and, one or more resistance straps connectable between said translation member and said mounting bracket.

10. A treadmill conversion apparatus as in claim 9, wherein said handle articulation joint further includes adjustable rotational resistance means.

11. A treadmill conversion apparatus as in claim 9 or 10, further comprising a bench able to fit over said treadmill treadway.

12. A treadmill conversion apparatus as in claim 10, wherein said handle articulation joint adjustable resistance means comprises one or more friction disks.

13. A treadmill conversion apparatus as in claim 9, wherein each of said mounting brackets comprises first and second opposing bracket pieces matable around a vertical column of said treadmill.

14. A treadmill conversion apparatus as in claim 9, wherein each of said resistance attachments further includes one or more retaining straps connectable around said mounting bracket.

15. A treadmill conversion apparatus as in claim 4, further comprising, wherein said resistance strap connection point is selectable from said plurality of handle indexing holes.

* * * * *